US008522694B2

(12) United States Patent
Linares

(10) Patent No.: US 8,522,694 B2
(45) Date of Patent: Sep. 3, 2013

(54) STRUCTURAL SUPPORTING PALLET CONSTRUCTION WITH IMPROVED PERIMETER IMPACT ABSORBING CAPABILITIES

(75) Inventor: Miguel A. Linares, Bloomfield Hills, MI (US)

(73) Assignee: Oria Collapsibles, LLC, Auburn Hills, MI (US)

( * ) Notice: Subject to any disclaimer, the term of this patent is extended or adjusted under 35 U.S.C. 154(b) by 0 days.

(21) Appl. No.: 13/414,010

(22) Filed: Mar. 7, 2012

(65) Prior Publication Data

US 2012/0160137 A1 Jun. 28, 2012

Related U.S. Application Data

(63) Continuation-in-part of application No. 12/467,601, filed on May 18, 2009, now abandoned, which is a continuation-in-part of application No. 12/414,017, filed on Mar. 30, 2009, now Pat. No. 8,196,527, application No. 13/414,010, which is a continuation-in-part of application No. 13/081,953, filed on Apr. 7, 2011, which is a continuation-in-part of application No. 12/608,512, filed on Oct. 29, 2009, now Pat. No. 8,146,516, which is a continuation-in-part of application No. 12/414,017, filed on Mar. 30, 2009, now Pat. No. 8,196,527, and a continuation-in-part of application No. 12/467,601, filed on May 18, 2009, now abandoned.

(60) Provisional application No. 61/074,306, filed on Jun. 20, 2008, provisional application No. 61/328,682, filed on Apr. 28, 2010, provisional application No. 61/522,847, filed on Aug. 12, 2011.

(51) Int. Cl.
*B65D 19/38* (2006.01)

(52) U.S. Cl.
USPC ..... 108/57.25; 108/51.11

(58) Field of Classification Search
USPC ..... 108/51.11, 57.25, 51.3, 56.1, 57.12, 108/27.29, 57.26, 57.27, 901, 902
See application file for complete search history.

(56) References Cited

U.S. PATENT DOCUMENTS

| | | | |
|---|---|---|---|
| 1,557,935 | A | 10/1925 | Henroz |
| 2,383,736 | A | 8/1945 | Rembert et al. |
| 2,477,852 | A | 8/1949 | Bacon |
| 2,544,657 | A | 3/1951 | Cushman |
| 2,709,559 | A | 5/1955 | Geisler |

(Continued)

FOREIGN PATENT DOCUMENTS

| | | | |
|---|---|---|---|
| DE | 19541243 | A1 | 5/1997 |
| JP | 60-068254 | A | 4/1985 |

(Continued)

*Primary Examiner* — Jose V Chen
(74) *Attorney, Agent, or Firm* — Gifford, Krass, Sprinkle, Anderson & Citkowski, P.C.; Douglas J. McEvoy

(57) ABSTRACT

A pallet having a three dimensional body exhibiting a generally planar upper surface and a plurality of depth extending underside portions defining a plurality of spaced apart forklift receiving apertures. A plurality of impact absorbing members are positioned at spaced locations about a perimeter of the body. A structural defining inner grid includes pluralities of spaced apart and crosswise extending ribs for supporting inner extending reinforcing members seating within pockets defined in said ribs and including at least one of lengthwise and diagonal extending members.

18 Claims, 7 Drawing Sheets

(56) References Cited

U.S. PATENT DOCUMENTS 2,913,206 A 11/1959 Paris
2,914,282 A 11/1959 Budd
3,002,249 A 10/1961 Jackson
3,015,470 A 1/1962 Patchen
3,157,910 A 11/1964 Schlipphak
3,161,247 A 12/1964 Mackie
3,223,379 A 12/1965 Erickson
3,226,764 A 1/1966 Hostettler
3,267,882 A 8/1966 Edward et al.
3,276,530 A 10/1966 Borneman
3,310,616 A 3/1967 Beary
3,351,027 A 11/1967 Ellard, Jr. et al.
3,379,271 A 4/1968 Arthur et al.
3,382,550 A 5/1968 Smith et al.
3,412,439 A 11/1968 Baker
3,416,203 A 12/1968 Ozenne et al.
3,440,976 A 4/1969 Burne
3,448,496 A 6/1969 Arnold et al.
3,513,934 A 5/1970 Crowley
3,556,886 A 1/1971 Reusser
3,568,912 A 3/1971 de Simas
3,580,190 A * 5/1971 Fowler ..... 108/57.25
3,587,479 A 6/1971 Geschwender
3,590,446 A 7/1971 Sonneville
3,659,986 A 5/1972 Gelbman
3,664,272 A 5/1972 Sanders
3,675,595 A 7/1972 Sullivan
3,710,733 A 1/1973 Story
3,719,157 A 3/1973 Arcocha et al.
3,720,176 A 3/1973 Munroe
3,724,979 A 4/1973 Maringer et al.
3,733,157 A 5/1973 Hendry
3,756,342 A 9/1973 Burdick
3,760,899 A 9/1973 Crossman et al.
3,801,255 A 4/1974 Meyer et al.
3,814,778 A 6/1974 Hosoda et al.
3,832,955 A 9/1974 Pottinger et al.
3,859,021 A 1/1975 Kleiber
3,873,257 A 3/1975 Vanotti
3,897,186 A 7/1975 Farfor
3,920,369 A 11/1975 Boehringer et al.
3,942,926 A 3/1976 Bulloch, Jr.
3,955,613 A 5/1976 Lund
3,981,956 A 9/1976 Redmer et al.
3,982,057 A 9/1976 Briggs et al.
3,982,874 A 9/1976 Nobbe
3,989,090 A 11/1976 Kawai
4,063,864 A 12/1977 Oberwelland et al.
4,068,993 A 1/1978 Dacey et al.
4,105,383 A 8/1978 Hanson
4,197,065 A 4/1980 Di Rosa
4,220,100 A 9/1980 Palomo et al.
4,272,856 A 6/1981 Wegener et al.
4,279,583 A 7/1981 Martin, Sr.
4,312,152 A 1/1982 Drury et al.
4,369,024 A 1/1983 Blackwood et al.
4,413,964 A 11/1983 Winstead
4,416,385 A 11/1983 Clare et al.
4,417,639 A 11/1983 Wegener
4,456,449 A 6/1984 Schubert et al.
4,507,348 A 3/1985 Nagata et al.
4,509,637 A 4/1985 Browning
4,520,746 A 6/1985 Walters et al.
4,597,338 A 7/1986 Kreeger
4,611,978 A 9/1986 Sangiorgi
4,715,294 A 12/1987 Depew
4,758,148 A 7/1988 Jidell
4,802,836 A 2/1989 Whissell
4,819,449 A 4/1989 Curti et al.
4,829,909 A 5/1989 Mandel
4,832,562 A 5/1989 Johnson
4,832,587 A 5/1989 Rensen
4,836,762 A 6/1989 Davis, Jr.
4,843,976 A 7/1989 Pigott et al.
4,923,661 A 5/1990 Russo
4,931,340 A 6/1990 Baba et al.
5,023,037 A 6/1991 Zullig
5,032,072 A 7/1991 Heuschkel
5,035,594 A 7/1991 Murayama et al.
5,067,189 A 11/1991 Weedling et al.
5,076,176 A 12/1991 Clasen
5,080,840 A 1/1992 Jost et al.
5,082,712 A 1/1992 Starp
5,143,778 A 9/1992 Shuert
5,171,586 A 12/1992 Heath
5,205,221 A 4/1993 Melin et al.
5,290,165 A 3/1994 Pitha
5,304,050 A 4/1994 Vismara
5,320,048 A 6/1994 Feiner
5,365,858 A 11/1994 Kuhns
5,368,466 A 11/1994 Hehl
5,382,152 A 1/1995 Ravera
5,391,387 A 2/1995 Peters
5,395,227 A 3/1995 Huggins, Sr. et al.
5,401,456 A 3/1995 Alesi, Jr. et al.
5,423,428 A 6/1995 Selz
5,445,514 A 8/1995 Heitz
5,451,157 A 9/1995 Gimenez
5,463,965 A 11/1995 Cordrey
5,473,995 A 12/1995 Gottlieb
5,476,048 A 12/1995 Yamashita et al.
5,537,741 A 7/1996 Peterson et al.
5,551,353 A 9/1996 Fiedler
5,579,686 A 12/1996 Pigott et al.
5,605,102 A 2/1997 Simpson
5,612,064 A 3/1997 Kosman
5,687,652 A 11/1997 Ruma
5,709,913 A 1/1998 Andersen et al.
5,755,162 A 5/1998 Knight et al.
5,769,949 A 6/1998 Cienkus et al.
5,846,576 A 12/1998 Braungardt et al.
5,868,080 A 2/1999 Wyler et al.
5,890,437 A 4/1999 Hill
5,967,057 A * 10/1999 Nakayama et al. ..... 108/57.25
6,093,011 A 7/2000 Kosman
6,209,464 B1 4/2001 Elder
6,224,363 B1 5/2001 Mahan et al.
6,250,234 B1 * 6/2001 Apps ..... 108/57.25
6,294,114 B1 9/2001 Muirhead
6,357,364 B1 3/2002 Maloney et al.
6,357,366 B1 3/2002 Frankenberg
6,524,426 B1 2/2003 St. John et al.
6,530,330 B2 3/2003 Sepe et al.
6,530,769 B1 3/2003 Rondeau et al.
6,569,509 B1 5/2003 Alts
6,582,216 B2 6/2003 Kosman
6,598,541 B2 7/2003 Vilkki
6,622,642 B2 * 9/2003 Ohanesian ..... 108/57.25
6,655,299 B2 12/2003 Preisler et al.
6,705,237 B2 3/2004 Moore, Jr. et al.
6,718,888 B2 * 4/2004 Muirhead ..... 108/57.25
6,745,703 B2 6/2004 Torrey et al.
6,758,148 B2 * 7/2004 Torrey et al. ..... 108/51.11
6,807,910 B2 * 10/2004 Apps ..... 108/57.25
6,863,003 B2 3/2005 Grainger
6,938,559 B2 9/2005 Wullenweber
6,954,982 B2 10/2005 Isle et al.
6,972,144 B2 12/2005 Roth et al.
6,976,437 B2 12/2005 Fisch et al.
6,986,309 B2 * 1/2006 Sugihara et al. ..... 108/57.25
7,013,814 B2 3/2006 Modesitt et al.
7,143,564 B2 12/2006 Renck
7,150,621 B2 12/2006 Molin
7,197,989 B2 4/2007 Apps
7,238,073 B2 7/2007 Hendrickson
7,255,551 B2 8/2007 Taylor et al.
7,309,226 B2 12/2007 Hansen et al.
7,458,800 B2 12/2008 Scherer et al.
7,469,643 B2 12/2008 Isle et al.
7,658,958 B2 2/2010 Hansen
7,726,248 B2 6/2010 Shuert
7,804,400 B2 9/2010 Muirhead
7,819,068 B2 10/2010 Apps et al.
8,047,886 B1 11/2011 McLarty et al.

2001/0050035 A1 12/2001 Mahnken
2002/0007770 A1 1/2002 Vilkki
2002/0106483 A1 8/2002 Obeshaw
2002/0134311 A1 9/2002 Yoshino et al.
2002/0148393 A1 10/2002 Milles
2003/0024443 A1 2/2003 Hoshi
2003/0041956 A1 3/2003 Pigott et al.
2003/0061974 A1* 4/2003 Smyers ..... 108/56.1
2003/0070594 A1 4/2003 Isle et al.
2003/0118681 A1 6/2003 Dahl et al.
2003/0136315 A1 7/2003 Kim
2003/0189152 A1 10/2003 Elder et al.
2004/0007164 A1 1/2004 Herring et al.
2004/0187745 A1 9/2004 Rojas et al.
2005/0076816 A1 4/2005 Nakano
2005/0155528 A1* 7/2005 Moore et al. ..... 108/51.3
2005/0211139 A1 9/2005 Perrotta et al.
2005/0241548 A1 11/2005 Muirhead
2006/0003044 A1 1/2006 DiNello et al.
2006/0075939 A1 4/2006 Shuert
2006/0130712 A1 6/2006 Wang
2006/0134254 A1 6/2006 Hansen et al.
2006/0144301 A1 7/2006 Borggaard
2006/0191465 A1 8/2006 Marcellus
2006/0201402 A1 9/2006 Moore et al.
2006/0235780 A1 10/2006 Carney
2006/0288915 A1 12/2006 Kulbeth et al.
2007/0215014 A1 9/2007 Lee
2007/0283857 A1 12/2007 Dong
2008/0053596 A1 3/2008 Davies et al.
2008/0060561 A1 3/2008 Carrasco
2008/0098935 A1 5/2008 Roth et al.
2008/0103944 A1 5/2008 Hagemann et al.
2008/0110377 A1 5/2008 Stevens
2008/0156234 A1 7/2008 van de Camp
2008/0196633 A1 8/2008 Ho
2008/0210140 A1* 9/2008 Valentinsson ..... 108/57.25
2009/0000527 A1* 1/2009 Ficker ..... 108/57.25
2009/0007824 A1* 1/2009 Dubois et al. ..... 108/57.25
2009/0095172 A1 4/2009 Madgar
2009/0188096 A1 7/2009 Townsend et al.
2010/0043678 A1 2/2010 Linares
2010/0154685 A1 6/2010 Arinstein
2010/0229764 A1* 9/2010 Ingham ..... 108/51.3
2011/0120353 A1* 5/2011 Jensen et al. ..... 108/57.25
2011/0240800 A1 10/2011 Fox, Jr.
2012/0291678 A1* 11/2012 Howland et al. ..... 108/53.3

FOREIGN PATENT DOCUMENTS

JP 60-148453 A 8/1985
JP 02139341 A 5/1990
JP 03029744 A 2/1991
JP 06156493 A 6/1994
JP 06-235780 A 8/1994
JP 08034014 A 2/1996
JP 08034438 A 2/1996
JP 08336866 A 12/1996
JP 11079180 A 3/1999
JP 11221828 8/1999
JP 2000085021 A 3/2000
JP 2001-328632 A 11/2001
JP 2002166940 A 6/2002
JP 2003011969 A 1/2003
JP 2003-034330 A 2/2003
JP 2003-267370 A 9/2003
JP 2004090988 A 3/2004
JP 2005104562 A 4/2005
JP 2006036315 A 2/2006
JP 2006036331 A 2/2006
JP 2006298403 A 11/2006
JP 2008023741 A 2/2008
JP 2008087839 A 4/2008
KR 20030034370 A 5/2003
KR 10-0577441 5/2006
KR 1020090117107 11/2009
WO 2006082595 A1 8/2006

* cited by examiner

STRUCTURAL SUPPORTING PALLET CONSTRUCTION WITH IMPROVED PERIMETER IMPACT ABSORBING CAPABILITIES

CROSS REFERENCE TO RELATED APPLICATIONS

The present application claims the benefit of Provisional Application No. 61/522,847, filed Aug. 12, 2011. This Application is also a Continuation-in-part of application Ser. No. 12/467,601 filed on May 18, 2009, which claims the benefit of U.S. Provisional Application 61/074,306 filed on Jun. 20, 2008 and is a Continuation-in-part of application Ser. No. 12/414,017 filed on Mar. 30, 2009. This Application is also a Continuation-in-part of application Ser. No. 13/081,953 filed on Apr. 7, 2011, which claims the benefit of U.S. Provisional Application 61/328,682 filed on Apr. 28, 2010 and is a Continuation-in-part of application Ser. No. 12/608,512 filed on Oct. 29, 2009, which is a Continuation-in-part of both application Ser. No. 12/467,601 filed on May 18, 2009 and application Ser. No. 12/414,017 filed on Mar. 30, 2009.

FIELD OF THE INVENTION

A structural supporting and stackable pallet construction incorporating a reinforcing and internal grid like skeletal structure exhibiting enhanced load characteristics. A plurality of perimeter located impact absorbing members are arranged about the sides of the pallet and operate to minimize the damage inflicted by forklift inserting forks within configured receipt apertures in the sides of the pallet in order to maintain and extend the useful life of the assembly.

DESCRIPTION OF THE RELEVANT ART

The relevant art is well documented with various type of pallet designs. In additional to conventional wood pallets, additional materials including plastics and the like have been utilized in the construction of load bearing pallets, with varying degrees of effectiveness.

SUMMARY OF THE PRESENT INVENTION

The present invention discloses a pallet exhibiting a rectangular shaped and three dimensional body including an outer frame and a pair of inner and crosswise extending grid supports. Each of a plurality of sides associated with the outer frame further includes at least one forklift receiving apertures. A plurality of individual support surfaces are established between the outer frame and the inner extending crosswise supports, a corresponding plurality of planar shaped portions being installed upon the support surfaces and establishing a generally flush appearance with surrounding top edges of the body.

Additional features include the outer frame and inner crosswise extending supports being constructed of any of a wood, polymer, polymer composite or metal. Reinforcing brackets are secured to underside edges of the outer frame in order to establish the forklift receiving apertures. Underside projecting stand-offs associated with at least the crosswise supports are provided for creating structural support along an entire underside area associated with the body.

Other features include the provision of inner ledge supports extending around an inner perimeter defined by each of the individual support surfaces for supporting an installed planar shaped portion. An aperture pattern may also be defined in each of the outer frame and inner crosswise extending supports.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Referring now to the following illustrations, a series of variants are shown of a structural supporting and stackable pallet construction incorporating a reinforcing and internal grid like skeletal structure exhibiting enhanced load characteristics. This, combined with perimeter located impact absorbing members arranged about the sides of the pallet, minimizes the damage inflicted by forklift inserting forks within configured receipt apertures in the sides of the pallet in order to maintain and extend the useful life of the assembly.

The stackable pallet construction is designed so as to provide heavy duty support of items located thereupon and exhibits, according to the selected variant, a structural spine or insert (such as a heavy duty paperboard corrugated material or galvanized insert) which operates to greatly enhance the strength of the pallet assembly in supporting heavier loads set thereupon.

As will be further described in detail, the material construction of the pallets includes any combination of heavy duty paperboard, plastic, metal or composite admixture. As will be additionally described, the completed pallet article encompasses any desired arrangement or pattern of interiorly extending open apertured locations, recesses or other configurations, these further reducing the overall weight of the pallet without compromising its strength. The underside of each pallet can further exhibit linear width and/or length extending recesses, and which are designed to seat inserting forks associated with a conventional forklift machine.

Figure 1:
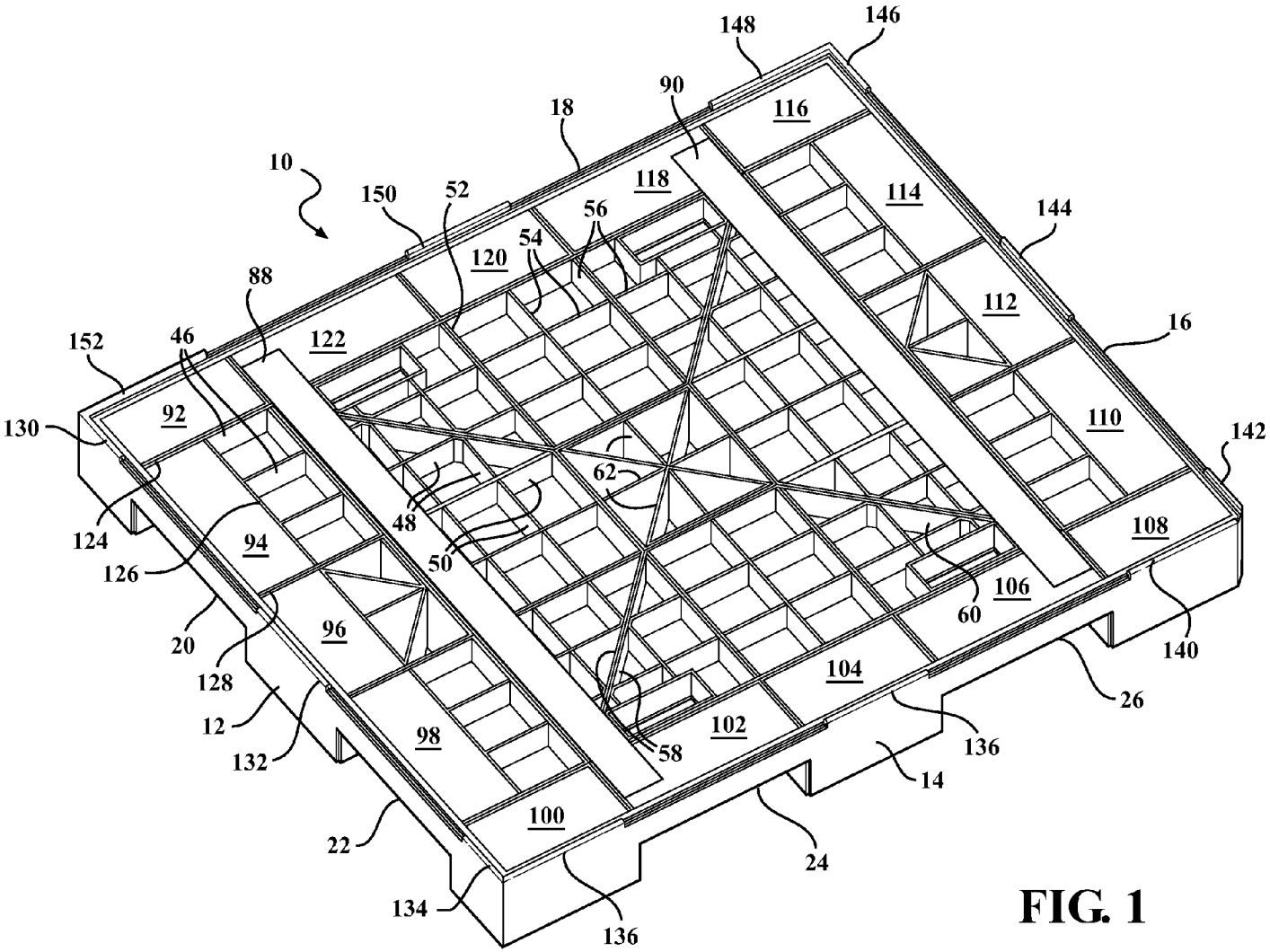
FIG. 1 is an upper perspective of a pallet construction, with top layer removed, and illustrating the combination of features including grid reinforcing inner construction, additional supporting material reinforcement members, and perimeter edge extending impact absorbing members.

Referring now to FIG. 1, an upper perspective is generally shown at 10 of a pallet construction, with top layer removed, and which exhibits a generally flattened rectangular shape with an established thickness. The pallet is constructed of any suitable material, including any paperboard like corrugated material, plastic or composite thereof and exhibits a generally rectangular profile with four sides 12, 14, 16 and 18, each of which are further configured to integrate lift fork receiving apertures, see upwardly recessed base surfaces at 20 and 22 for side 12 as well as further at 24 and 26 for adjoining side 14, with identical pairs of spaced apertures being associated with each of succeeding sides 16 and 18.

Figure 2:
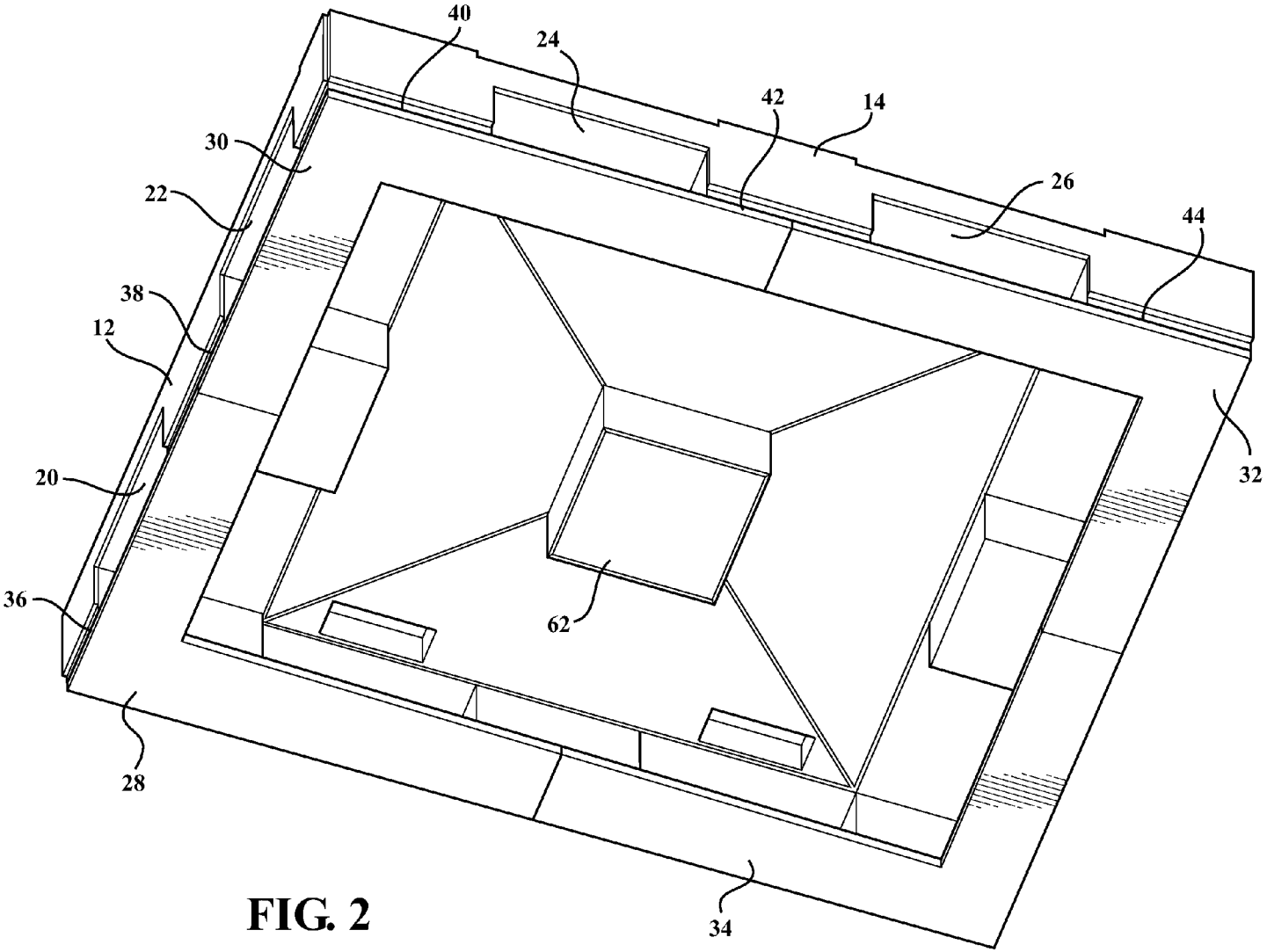
FIG. 2 is a further rotated underside view of the pallet construction and further depicting the optional underside standoff frame attachment for facilitating conveyor supporting of the pallets in combination with providing additional forklift retaining aspects.

The fork receiving apertures as shown exhibit three sided underside recessed and inner perimeter edges communicating with bottom surfaces of the associated sides 12, 14, 16 and 18. As further shown in the rotated underside view of FIG. 2, the pallet construction further includes an optional underside standoff frame attachment for facilitating conveyor supporting of the pallets in combination with providing additional forklift retaining aspects.

The frame attachment is depicted by four individual and end-to-end connected and flattened "L" shaped segments 28, 30, 32 and 34, it being understood that the frame attachment can be provided with any number of pieces, down to a one piece four sided frame, and which are permanently or releasably attached to underside surfaces of the pallet sides (see as shown by depicted underside surfaces 36, 38, 40, 42 and 44 for contiguous sides 12 and 14) with the use of any of clips, mechanical/chemical adhesives or the like. Without limitation, the frame attachments can be constructed of any suitable material not limited to a metal, plastic, wood or any manner or type of composite material. Secondary advantages associated with the bottom attachment frame include assisting in retaining the inserted forks of the lift.

Referring again to FIG. 1, an internal supporting grid arrangement is depicted and defines a reinforcing structural interior of the pallet. A plurality of interlocking ribs are arranged in a desired grid, pattern or lattice arrangement. These are depicted in FIG. 1 by extending and spaced apart pluralities of ribs 46, 48, 50, et seq. (extending between sides 12 and 16), crosswise extending and spaced apart ribs 52, 54, 56, et seq. (between alternating sides 14 and 18) and diagonal ribs 58 and 60.

Reinforced and deepened areas of the grid construction include a central most ribs 62 (see also FIGS. 2 and 4), as well as perimeter spaced portions 64, 66, 68, 70, 72, 74, 76 and 78 extending along sides 12, 14, 16 and 18. The arrangement and spacing of the deepened structural grid portions 64-78 define the underside receiving forklift apertures (again depicted at 20, 22, 24 and 26 for selected sides 12 and 14 and as further defined by pairs of spaced apart and vertical side surfaces 65, 67, 69 and 71 in FIG. 4 which establish the underside defining configuration for facilitating forklift insertion). Further hand hold apertures are shown at 80, 82, 84 and 86 in FIG. 4 and which are designed into the body of the pallet both to reduce overall weight as well as to provide for convenient grasping and transport of the pallet.

As with the top, bottom and side surface layers of the pallet the grid defining ribs are again constructed of any suitable corrugated paperboard, plastic or composite material. A suitable plasticized coating or spray, such as which enhances the structural aspects of the assembly as well as restricts/impedes/impairs the absorption and contamination of water, can also be either pre or post applied after assembly or molding of the grid members.

Additional structural reinforcing support can be provided in the form of elongated members 88 and 90 (depicted as substantially flattened and elongated slats), such as extending along interior intermediate locations of the pallet (in the illustrated instance in inwardly parallel spaced fashion relative to parallel sides 12 and 16). The elongated members 88 and 90 can exhibit any desired dimensions (length, width and thickness) as well as be constructed of any material including wood, plastic metal or composite material and which is dimensioned to fit within integrally configured channels or pockets defined within the interior grid structure of the pallet and for contributing additional structural support to the assembly.

Referring still to FIG. 1, a plurality of perimeter edge extending and individual impact absorbing members are depicted at 92-122 in contiguous and perimeter extending fashion around and in proximity to the sides 12, 14, 16 and 18. The impact absorbing members as shown each are constructed in a generally three dimensional rectangular block or brick shape (selected absorbing members 102, 106, 118 and 122 further exhibiting notched locations to seat extending ends of the inner elongated support members 88 and 90 as shown). The material construction of the impact absorbing members further can include any of a variety of materials, such as but not limited to a foam, corrugated paper or plastic.

As further shown in FIG. 1, additional perimeter located grid support locations are defined by additional ribs (see as representatively shown at 124, 126 and 128 in FIG. 1 in association with selected impact absorbing member 94 and located contiguous to a next intermediate row of inner structural rib supports represented by selected ribs 46). The inner interconnecting and crosswise extending relationship established by the ribs 124-128 is constructed so as to define individual cushioning/controlled collapsible pockets which, in the event of a misalignment impact of inserting lift forks (not shown) will facilitate localized impact absorption of the misdirected forks into one or more of the impact absorbing members, and further without materially impacting the overall structural integrity of the pallet, such as by unnecessarily deforming or impacting the next inner row 46 of ribs. The dimensions and construction of the impact absorbing members and associated periphery located and pocket defining ribs are further such that the members can be modified to assume any other desired shape or configuration, such as for adapting the pallet to any desired operating configuration, weight or support rating, and without otherwise impacting the operational capabilities of the design.

Figure 4:
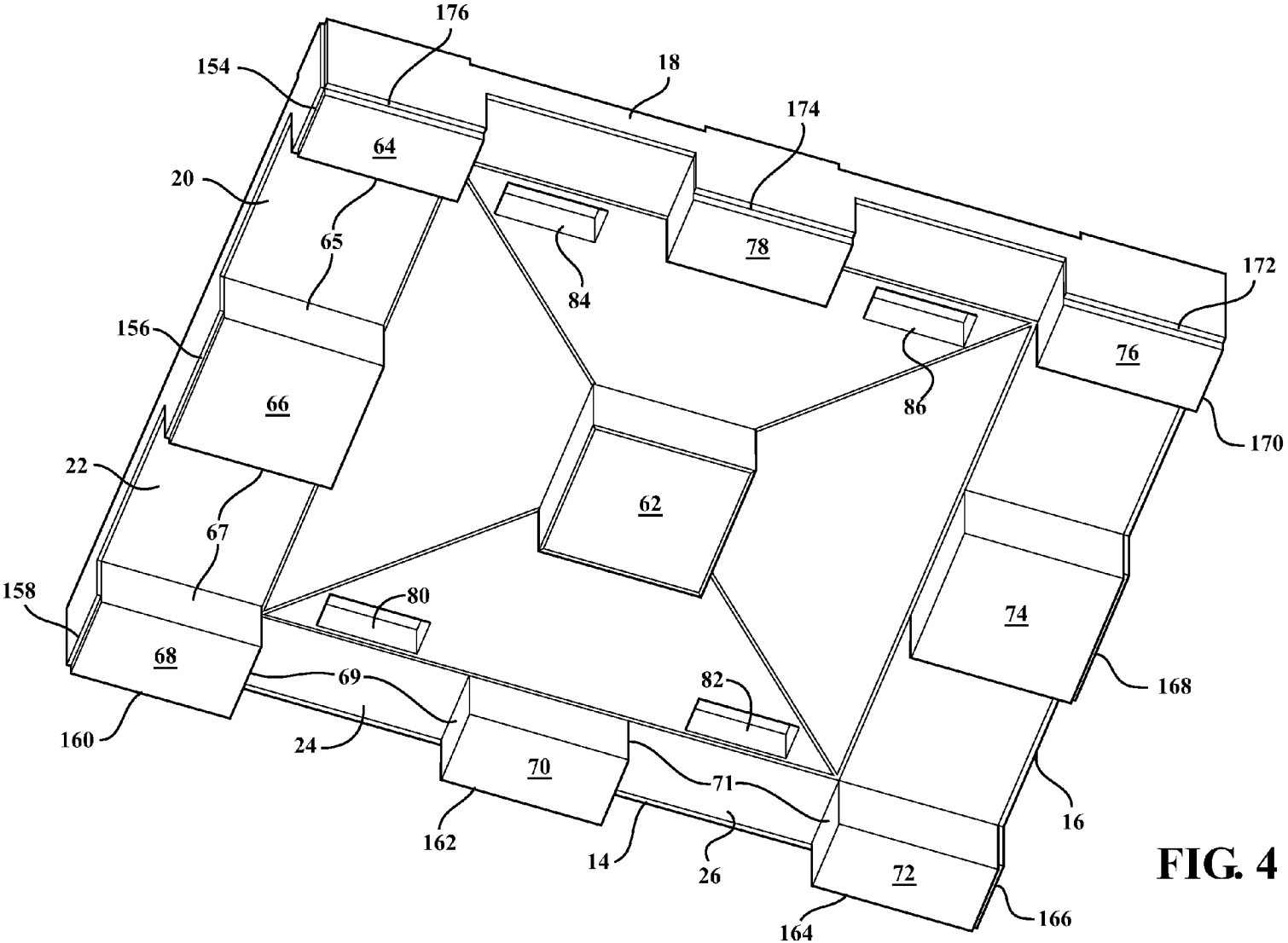
FIG. 4 is a rotated underside of either of FIGS. 1 and 3 and better showing the arrangement of hand holds in combination with the underside pallet profile.

Additional features include a plurality of upper edge extending and raised locating/alignment portions 130-152 extending at spaced apart locations about the periphery of the pallet (these again associated with an upper surface layer of the pallet which is removed in FIG. 1 to permit illustration of the interior components). The locating and alignment portions alternate with notched and inwardly stepped recesses associated with mating extending edge locations associated with the undersides of each pallet and, as best shown in the underside of FIG. 4, corresponds to mating lower edge locations 154-176 defined in the lower and edge spaced projecting portions 64-78, this facilitating secure stack-ability for storage or transport of the pallets when not in use.

Figure 3:
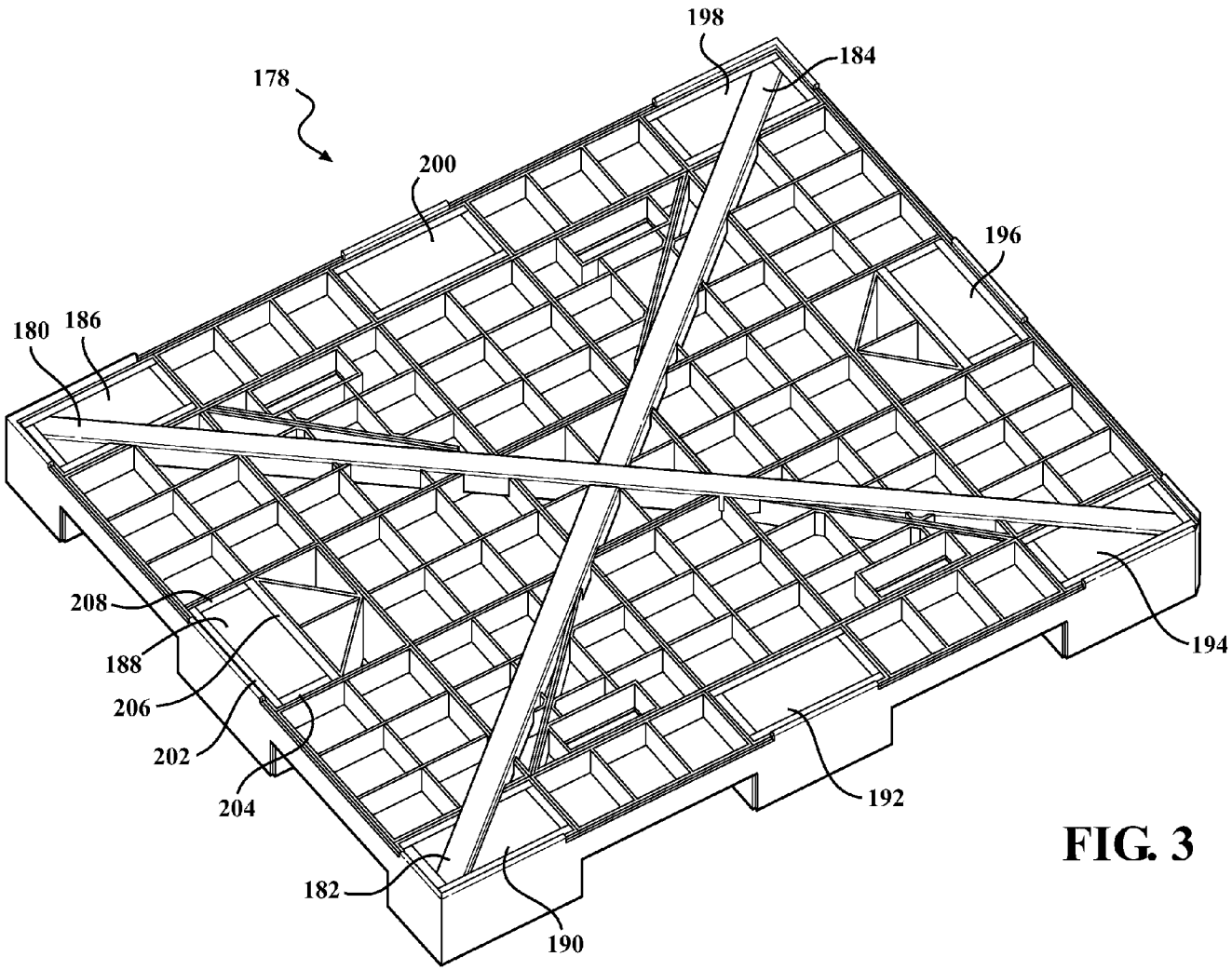
FIG. 3 is an upper perspective illustration of a modified pallet construction, again with top layer removed, and illustrating cross shaped reinforcement inserts in combination with modified configuration of impact absorbing members.

Referring now to FIG. 3, an upper perspective illustration is show of a modified pallet construction, generally shown at 178, again with top layer removed, and which illustrates cross shaped reinforcement inserts (see first diagonal extending insert 180 and cross wise extending and segmented diagonal inserts 182 and 184). The elongated inserts 180 and 182/184 each approximate the dimensions of a 2×2 stud or the like. In combination, a modified configuration of impact absorbing members is further depicted by a reduced number of spaced apart members 186-200, these located at end/corner and intermediate locations of the pallet sides and which are offset with the associated and underside defining fork recesses.

As shown, selected corner positioned impact absorbing members 186, 190, 194 and 198 are reconfigured to seat diagonal extending ends of the members 180, 182 and 184. Each impact absorbing member further includes a perimeter defining box of trim portions (see as representatively shown at 202, 204, 206 and 208 for selected impact absorbing member 188), these being constructed of any type of wood, plywood, plastic, metal or composite and which, in combination with a foam, corrugated paper or plastic composition associated with any of the impact absorbing members 186-200, provides a like desired degree of localized (lift fork) impact absorbing capabilities without compromising the overall integrity of the pallet.

The pallet 178 includes a similar arrangement of grid defining ribs as previously described in reference to FIG. 1 such that a repetitive description is unnecessary. The ribs are again configured integrally within the pallet interior to facilitate placement and location of the diagonal reinforcing supports 180, 182 and 184 and spaced apart outer perimeter located impact absorbing members 186-200, with the exception that they are reconfigured to the extent to accommodate the diagonal extending inner structural supports 180, 182 and 184 in substitution for the elongated inner extending supports 88 and 90 depicted in FIG. 1.

Figure 5:
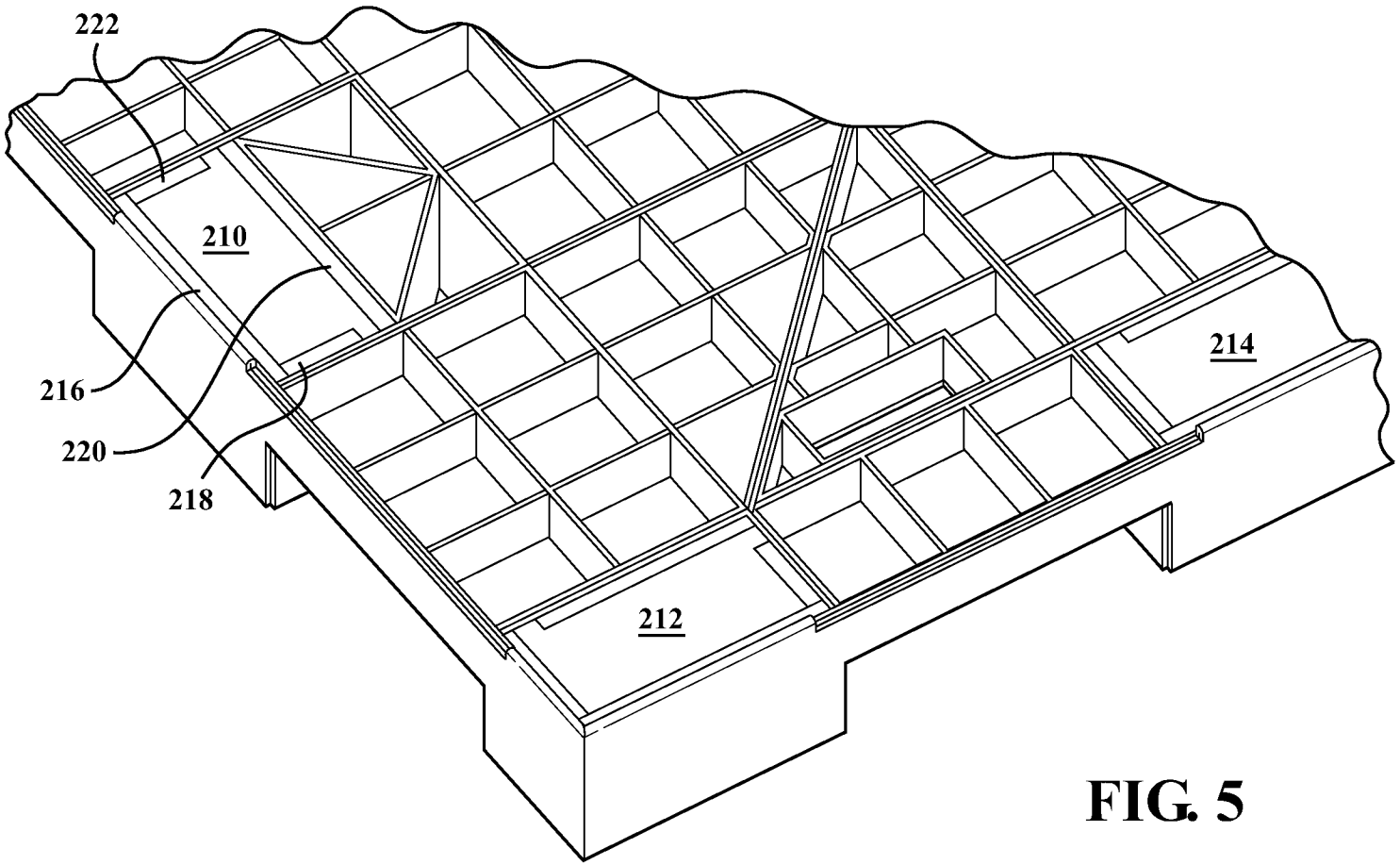
FIG. 5 is an enlarged upper side perspective and better depicting a further modification of the segmented energy absorbing members such as depicted in FIG. 3, these including individual section defining reinforcing members with engineered flex points.

FIG. 5 is an enlarged upper side perspective and better depicting a further modification of the segmented energy absorbing members, similar to as previously depicted in FIG. 3, and which is illustrated by selected absorbing portions 210, 212 and 214, each of which includes individual section defining reinforcing members with engineered flex points and as further depicted by respective offset trim portions 216, 218, 220 and 222 for selected absorbing portion 210. The inwardly extending gap or offset established between shorter trim portion legs 218 and 222, relative to outer 216 and inner parallel 220 trim pocket defining locations facilitates a degree of localized and inwardly flexing collapse which provides another variation of enhanced structural give in the event of a misalignment impact of a lift fork, again without impacting the overall integrity of the pallet construction.

Figure 6:
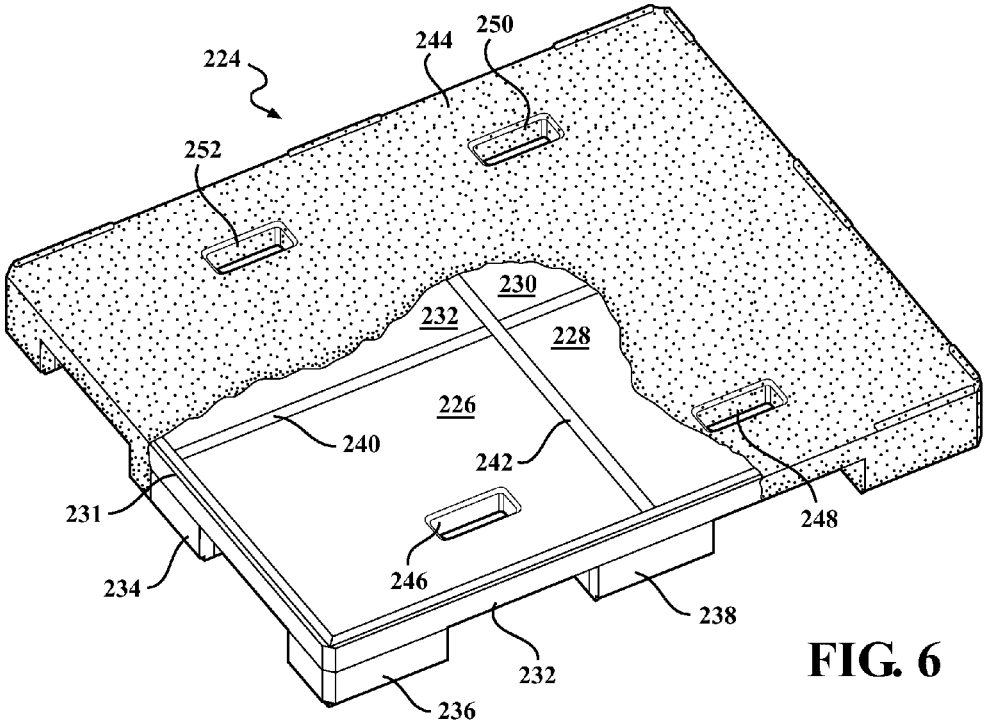
FIG. 6 is an upper facing perspective of a pallet construction according to a yet further variant and illustrating a substantially impact absorbing planar extending and load supporting surface with integrally formed outer and grid extending frame construction.

FIG. 6 is an upper facing perspective, generally at 224, of a pallet construction according to a yet further variant and illustrating a substantially impact absorbing planar extending and load supporting surface with integrally formed outer and grid extending frame construction. This is further evidenced by individual body sections 226, 228, 230 and 230, each of which are constructed of foam, corrugated or plastic materials and which are bounded by any of a metal, plastic, wood or composite outer frame, further depicted by outer frame/side defining members 231, 232, et seq. and corresponding and depth extending portions 234, 236, 238, et seq. which confirm with the individual planar foam or other sections 226, 228, 230 and 232 in order to collectively define the surface extending profile of the pallet 224.

A crosswise extending grid 240 and 242 is incorporated into the pallet construction 224 and integrates into the perimeter frame construction (such as depicted including a galvanized steel or like construction) to provide additional structural support to the design. An outer plasticized coating or spray 244 can be applied to the exterior of the individual and three dimensional formed sections 226-232 and associated galvanized frame surfaces 230-242. Suitable hand hold surfaces 246, 248, 250 and 252 can also be integrated into the design of the durable foam constructions 226-232 as shown.

Figure 7:
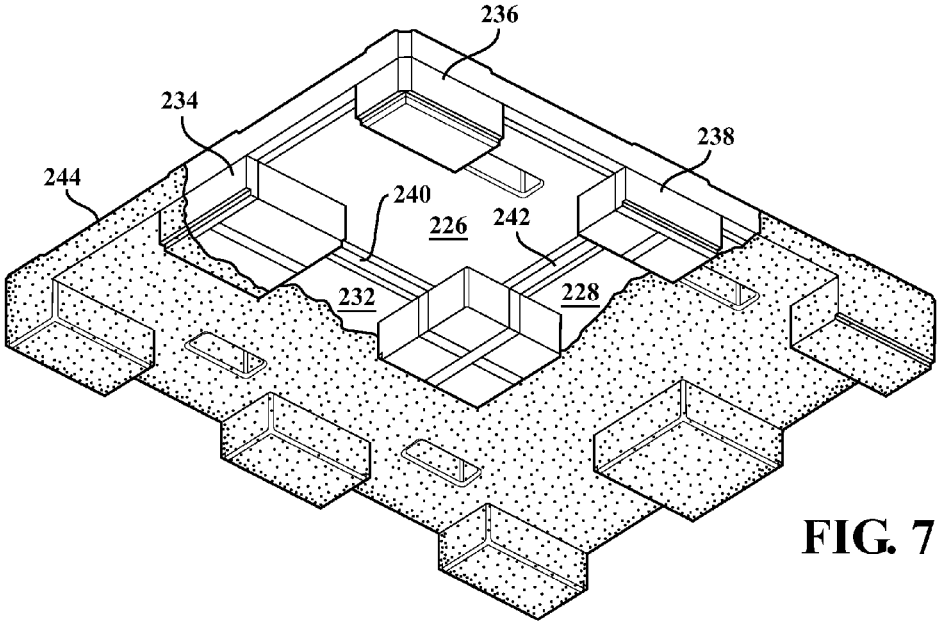
FIG. 7 is a rotated underside of the pallet construction of FIG. 6 and better depicting the features of the galvanized steel extending perimeter along with the provision of such as impact absorbing material strips filling inner channels associated with the galvanized supporting grid.

Referring to FIG. 7, a rotated underside of the pallet construction of FIG. 6 is depicted and better depicting the features of the galvanized steel extending perimeter along with the provision of such as impact absorbing material strips (again depicted by galvanized edge locations 234, 236, 238 et seq.) for providing a degree of combined surface protection and impact absorbing support to the pallet construction. The pallet configuration 224 of FIGS. 6 and 7 can further exhibit a substantially hollow interior construction within at least each of the enlarged and depth defining portions and which, in combination with the galvanized steel (or other) frame and foam section supporting surfaces, define a relatively lightweight and load capable bearing construction. The structural substrate can exhibit, without limitation, any desired length, width, height/thickness dimension. It is also envisioned and understood that the construction and arrangement of the interior structural supporting portions are not limited to those illustrated and that further structural defining interior patterns or structure beyond those shown are also envisioned.

Figure 8:
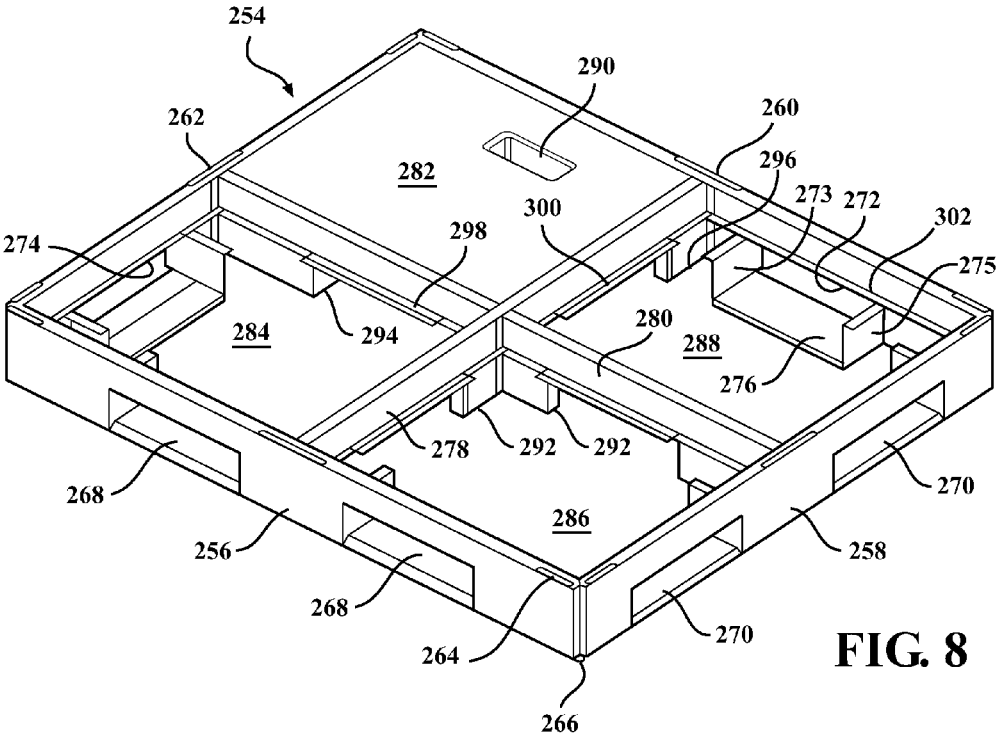
FIG. 8 is an upper facing perspective of a further variation of pallet construction including an outer frame and inner grid constructed of a wood or composite material and which defines a plurality of sections which are each filled with a foam or suitable composite material.

Referring now to FIG. 8, an upper facing perspective is generally depicted at 254 of a further variation of pallet construction and which includes a four sided outer structural wood, polymer, wood/polymer or other composite, constructed frame, see sides 256, 258, 260 and 262, each of which including upper edge extending and raised locating/aligning portions (for example at 264) and corresponding underside notched and inwardly stepped recesses (representatively at 266) similar to those previously described and for facilitating multiple stackability of the pallets when not in use. Each of the sides further exhibits lengthwise extending and rectangular shaped inner perimeter defining forklift receiving apertures, further defined in respective pairs 268, 270, 272 and 274 for each of corresponding sides 256, 258, 260 and 262. As best exemplified by selected lift receiving apertures 272, an inner extending and three sided bracket reinforcement, depicted by sides 237 and 275 with upwardly angled lip edges for engaging to the underside surface of the indicated extending side edge 272, with bottom interconnected shelf 276 a downwardly spaced distance therefrom in order to define a rectangular pocket of a dimension suitable for receiving an inserting lift fork and such as is provided for creating the side accessible lift aperture while at the same time cooperatively establishing additional structural integrity to the outer walls/sides of the frame construction.

An inner grid of crosswise extending supports is depicted at 278 and 280 and which are constructed of a wood or composite material, similar to the outer frame. Upon assembly, as shown, the inner grid defines a plurality of inner sections 282, 284, 286 and 288, the first of which is further depicted filled with a foam or suitable composite material in order to create a load supporting surface.

As with prior embodiments, the foam or composite planar subsection of material can be preformed to include an inner configured handhold, see further at 290, in order to facilitate ease of transport of the pallet. The grid supports 278 and 280 further depict underside extending stand-off locations, see at 292, 294 and 296 at both center and outer perimeter locations of at least the crosswise extending supports 278 and 280 in order to establish dimensional and load supporting stability across an entire underside surface area of the pallet assembly and to permit the configuration and dimensioning of the side disposed lift receiving apertures 268, 270, 272 and 274 in the deepened side members 256-262.

The individual sections 282, 284, 286 and 288 are further defined, by volume, by such as underside ledges (see for example at 298, 300, 302, et seq.) and which extending from each of four inwardly facing sides associated with the frame and crosswise support for individually supporting the tile or sheet constructed foam or composite sections 282 during installation. As shown, the inserted and structurally supported sheets (e.g. again at 282) exhibit a thickness less than the overall height of the pallet 254 and such that they seat within section defined apertures in supported fashion upon the inwardly extending side ledges 298, 300, 302 et seq., extending inwardly along each of four interconnected and inner perimeter defining sides and in a manner in which the top edges of the foam or composite sections extend flush with the top edge surfaces of the outer frame and inner crosswise extending supports.

Figure 9:
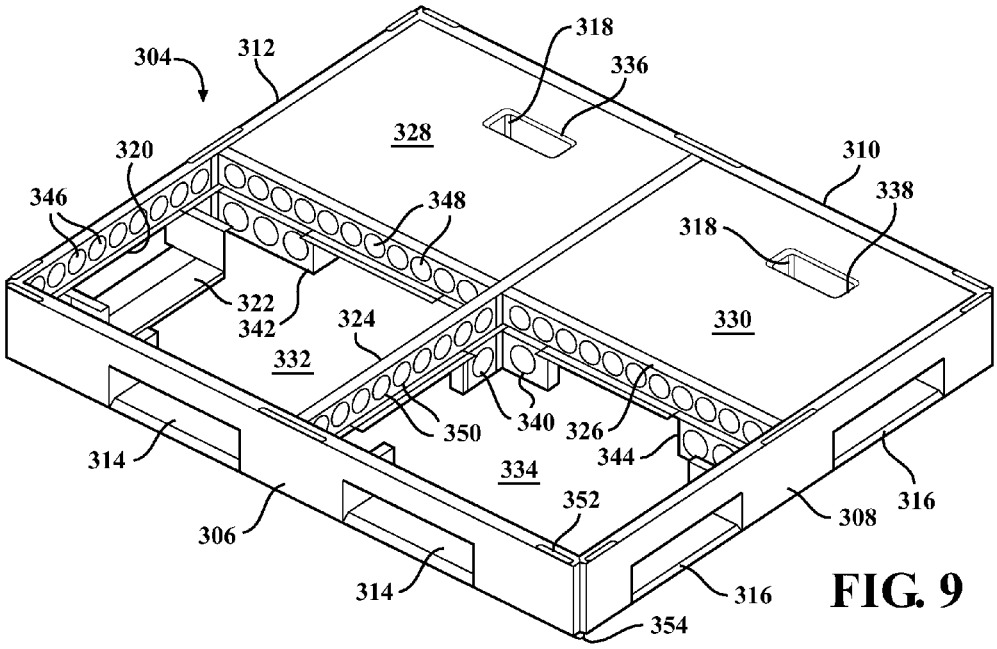
FIG. 9 is a yet further variation of a pallet construction of a nature depicted in FIG. 8 and further illustrating a metal outer frame and inner defining grid, the inner and crosswise extending grid members each exhibiting apertures which provide both weight reduction and/or permit inter-filling of any type of material such as a structural foam, wood, composite thereof or other fill-able material.

Referring finally to FIG. 9, a yet further variation of a pallet construction is generally shown at 304 of a nature depicted in FIG. 8 and further illustrating a four sided metal outer frame (sides 306, 308, 310 and 312) which include a similar arrangement of lengthwise extending and rectangular shaped inner perimeter defining forklift receiving apertures, and which are further defined in respective pairs 314 and 316 (with a portion of a further reverse side aperture 318 substantially hidden on the backside but evident through section hand holds) and further at 320 respectively for each of corresponding sides 306, 308, 310 and 312. As best exemplified by selected lift receiving apertures 320, a plurality of inner extending and three sided bracket reinforcements (such as representatively shown at 322) are constructed similar to as described in FIG. 8 and are again provided for creating the side accessible lift aperture as well as cooperatively establishing additional structural integrity to the outer walls/sides of the frame construction.

An inner grid of crosswise extending supports is depicted by members 324 and 326 which is constructed of a like metal material, similar to the outer frame. Upon assembly, as shown, the inner grid defines a plurality of inner sections 328, 330, 332 and 334, the first two of which are further depicted by foam or composite square shaped materials, or tiles, emplaced and in order to create a load supporting surface.

As with prior embodiments, the foam or composite planar subsection of material can be preformed to include inner configured handholds, see further at 336 and 338 formed in representative tiles 328 and 330, in order to facilitate ease of transport of the pallet. The grid supports 324 and 326 further depict underside extending stand-off locations, see at 340, 342, 344, et seq. at both center and outer perimeter locations in order to establish dimensional stability to the assembly and to permit the configuration and dimensioning of respective pairs of interconnected side disposed and lift receiving apertures 314, 316, 318 and 320.

Each of the outer frame defining members 306-312 and inner grid defining cross members 324 and 326 each exhibit a tight pattern of apertures, see at 346, 348, 350 et seq., which both serves to lighten the overall weight of the pallet as well as, in limited circumstances, to potentially communicate together all of the sections 328-334 during an associated in-fill process for introducing a flowable material into the section volumes in order to create a unitary pallet supporting surface.

Alternate to introducing pre-formed support sections (such as depicted at 282 in FIG. 8) such an alternate application can contemplate an inter-filling material such as a structural foam, wood or composite thereof. Addition of underside supporting ledges (as shown at 300, 302 et seq. in FIG. 8) can also be incorporated into the assembly of FIG. 9 in order to provide underside load bearing support to such as pre-formed sections 328, 330 during subsequent installation. As with the previous embodiment, stackable upper edge protrusions/guides and inwardly stepped/notched underside locations are again provided for, as shown at 352 and 354 respectively for each individual structural member and in order to facilitate ease of stackability as previously described.

Having described my invention, other and additional preferred embodiments will become apparent to those skilled in the art to which it pertains, and without deviating from the scope of the appended claims.

The invention claimed is:

1. A pallet comprising:

a three dimensional body exhibiting a generally planar upper surface and a plurality of depth extending underside portions defining a plurality of spaced apart forklift receiving apertures;

individual pluralities of interconnecting ribs being arranged in perimeter defining pockets within said body in proximity to each of said forklift receiving apertures; and a plurality of foam defining and impact absorbing sections seated within said pockets and positioned at spaced locations about a perimeter of said body in proximity to said forklift receiving apertures.

2. The pallet as described in claim 1, said body further comprising a structural defining inner grid including additional pluralities of spaced apart and crosswise extending ribs arranged between said perimeter extending impact absorbing sections.

3. The pallet as described in claim 2, further comprising elongated inserts seating within pockets defined in said inner grid defining ribs and including at least one of lengthwise and diagonal extending members.

4. The pallet as described in claim 1, further comprising inner perimeter defined handholds defined through said surface board and body.

5. The pallet as described in claim 1, further comprising stand-off attachments secured to underside perimeter extending locations of said body.

6. A pallet comprising:

a rectangular shaped and three dimensional body including an outer frame defined by a plurality of interconnecting side members and an inner frame defined by a pair of inner and crosswise extending grid supports extending between said side members;

each of said plurality of sides associated with said frame exhibiting forklift receiving apertures; and a plurality of ledges established within each of a plurality of inner subdivided areas between said outer frame side members and said inner crosswise extending grid members, a corresponding plurality of panel shaped portions being installed upon said ledges to establish a level appearance.

7. The pallet as described in claim 6, said outer frame and inner crosswise extending grid members being constructed of any of a wood, polymer, polymer composite or metal.

8. The pallet as described in claim 6, further comprising reinforcing brackets secured to underside edges of said outer frame in order to establish said forklift receiving apertures.

9. The pallet as described in claim 6, further comprising underside projecting stand-offs associated with at least said crosswise extending grid members for creating structural support along an entire underside area associated with said body.

10. The pallet as described in claim 6, said plurality of ledges further comprising a sub-plurality of four inner ledge supports extending around an inner perimeter defining each sub-divided area for supporting said panel shaped portion.

11. The pallet as described in claim 6, further comprising an aperture pattern defined in each of said outer frame side members and inner cross wise extending grid members.

12. The pallet as described in claim 6, further comprising a plasticized coating applied around said body.

13. The pallet as described in claim 6, further comprising a plurality of spaced apart and raised locating/aligning portions associated with an upper perimeter edge of said rectangular shaped body, a further plurality of underside notched and inwardly stepped recesses associated with an underside perimeter edge of said body and seating said raised upper edge portions of a succeeding body to facilitate multiple stackability.

14. A pallet comprising:

a three dimensional and substantially rectangular shaped body exhibiting a generally planar upper surface and a plurality of depth extending underside portions defining a plurality of spaced apart forklift receiving apertures;

said body including pluralities of spaced apart and crosswise extending ribs establishing an inner and structural defining grid;

inner extending reinforcing members seating within pockets defined in said ribs and including at least one of lengthwise and diagonal extending members; and additional pluralities of outer ribs arranged in perimeter extending fashion about said inner grid and in proximity to each of said forklift receiving apertures, a plurality of impact absorbing members being encased within selected sub-pluralities of said outer ribs which are in communication with interconnecting sides of said body, said outer ribs being configured to deform in order to localize any damage to said body caused by lift fork impact, such as resulting from misalignment with said lift receiving apertures.

15. The pallet as described in claim 14, further comprising inner perimeter defined handholds defined through said upper surface and body.

16. The pallet as described in claim 14, said impact absorbing members further comprising foam absorbing sections arranged around a perimeter of said body.

17. The pallet as described in claim 16, further comprising individual perimeter defining trim portions associated with each of a plurality of spaced apart pockets for receiving said impact absorbing sections.

18. The pallet as described in claim 14, further comprising stand-off attachments secured to underside perimeter extending locations of sad body.

* * * * *